US006943786B1

(12) United States Patent
Birk et al.

(10) Patent No.: US 6,943,786 B1
(45) Date of Patent: Sep. 13, 2005

(54) DUAL VOLTAGE SWITCH WITH PROGRAMMABLE ASYMMETRIC TRANSFER RATE

(75) Inventors: Christian S. Birk, Tucson, AZ (US); A. Paul Brokaw, Tucson, AZ (US)

(73) Assignee: Analog Devices, Inc., Norwood, MA (US)

( * ) Notice: Subject to any disclaimer, the term of this patent is extended or adjusted under 35 U.S.C. 154(b) by 330 days.

(21) Appl. No.: 10/359,909

(22) Filed: Feb. 7, 2003

(51) Int. Cl.[7] ..... G09G 5/00
(52) U.S. Cl. ..... 345/204; 345/212; 345/214
(58) Field of Search ..... 345/89–100, 204, 345/147, 148, 212, 214, 690–699; 330/253; 257/59; 327/319

(56) References Cited

U.S. PATENT DOCUMENTS 5,497,122 A * 3/1996 Somayajula ..... 330/253
5,587,722 A 12/1996 Suzuki et al. ..... 345/94
5,831,467 A * 11/1998 Leung et al. ..... 327/319
6,031,248 A * 2/2000 Mei et al. ..... 257/59
6,046,719 A * 4/2000 Dingwall ..... 345/100
6,618,043 B2 * 9/2003 Washio et al. ..... 345/204
6,744,417 B2 * 6/2004 Yamashita et al. ..... 345/92

* cited by examiner

*Primary Examiner*—Bipin Shalwala
*Assistant Examiner*—Prabodh Dharia
(74) *Attorney, Agent, or Firm*—Koppel, Jacobs, Patrick & Heybl

(57) ABSTRACT

A dual voltage switch enables the generation of a pulse which toggles between user-provided first and second voltages (V1 and V2), for which the positive and/or negative slew rates are programmable by means of a user-provided capacitance. A first switch conducts a current I1 between V1 and a common output node in response to a first control voltage, and a second switch conducts a current I2 between V2 and the common output node in response to a second control voltage. A capacitance C is connected to the common output node. A control circuit alternately provides the first and second control voltages such that the common output node is pulled up to V1 at a transfer rate of I1/C when the first control voltage is provided, and pulled down to V2 at a transfer rate of –I2/C when the second control voltage is provided.

26 Claims, 7 Drawing Sheets

DUAL VOLTAGE SWITCH WITH PROGRAMMABLE ASYMMETRIC TRANSFER RATE

BACKGROUND OF THE INVENTION

1. Field of the Invention

This invention relates to the field of switches, and particularly to switches having programmable transfer rates.

2. Description of the Related Art

A conventional active matrix liquid crystal display (LCD) device will be briefly described with reference to FIG. 1*a*, which shows a typical equivalent circuit diagram showing an area including one pixel. Each pixel 2 is located at an intersection between a gate line X and a signal line Y. The pixel is comprised of a liquid crystal material and has an equivalent capacitance $C_{LC}$. The liquid crystal capacitance is connected to a driver transistor TFT1 at one end, and to a reference voltage $V_{com}$ at its other end. TFT1 typically comprises a MISFET-type thin film transistor (TFT). The drain of TFT1 is connected to signal line Y to receive a video signal $V_{sig}$, and TFT1's source is connected to $C_{LC}$; i.e., the pixel electrode. The gate of TFT1 is connected to gate line X.

In operation, a pulse with a voltage $V_{gate}$ is applied to the gate of TFT1, which turns on and connects $V_{sig}$ to pixel 2 to charge $C_{LC}$. Ideally, $V_{sig}$ is maintained by $C_{LC}$ and the pixel excitation remains constant after the termination of the gate pulse. However, a coupling capacitance $C_{GS}$ is present between pixel 2 and the gate of TFT1. Coupling capacitance $C_{GS}$ is a combination of a floating capacitance component between the pixel electrode and the gate line X, and a parasitic capacitance component between the source area and a gate area within TFT1. The parasitic capacitance component is predominant, and tends to vary from one TFT to another.

When the drive pulse goes positive to turn on TFT1, the charge on $C_{GS}$ is coupled to $C_{LC}$, which results in a positive voltage shift $+\Delta V$ in $V_{sig}$ as applied to pixel 2. However, with TFT1 on, the charge delivered by $C_{GS}$ is bled off to the low-impedance amplifier (not shown) driving column line Y via TFT1, such that the positive shift subsides quickly.

However, when the drive pulse falls, pixel capacitance $C_{LC}$ is coupled to $C_{GS}$ and $C_{LC}$ is partially discharged. As illustrated in the timing diagram shown in FIG. 1*b*, this results in a negative voltage shift $-\Delta V$ in $V_{sig}$ as applied to pixel 2. Here, though, switch TFT1 is off; as such, the coupled charge is not bled off and voltage shift $-\Delta V$ is maintained throughout TFT1's off-time.

Since $C_{GS}$ varies from one TFT to another, $\Delta V$ will also vary from pixel to pixel. The transmissivity of the pixel is dependent on the effective voltage applied across it; as such, voltage shift $\Delta V$ and its variability from pixel to pixel can cause significant deterioration in the quality of the displayed image.

One approach to reducing $\Delta V$ requires connecting an auxiliary capacitor $C_S$ across pixel 2. This additional capacitance is intended to compensate for the charge lost to coupling capacitor $C_{GS}$ when the gate pulse ends, and thereby reduce the magnitude of $\Delta V$. However, capacitor $C_S$ is necessarily formed in the pixel area. As such, the presence of $C_S$ may compromise the opening ratio of the pixel and degrade the display's contrast.

Another way to reduce the magnitude of $\Delta V$ is to "shape" the falling edge of the gate pulse to smooth its transition from high to low and thereby increase the pulse's fall time. In this way, the switch is at least partially on during the pulse's fall time, which allows at least some of the charge to be bled back to the column amplifier via TFT1. Since this charge is presumably small in comparison with the video signal, most of it can be bled off during the slow fall time, even though the resistance of TFT1 is rising.

One way to shape the gate pulse's falling edge is described in U.S. Pat. No. 5,587,722 to Suzuki et al. Here, gate pulses are provided to each TFT via respective inverters, each of which is made up of an n-type transistor and a p-type transistor, with the p-type transistor having a larger current capacity than the n-type transistor. When the gate pulse transitions from low to high, the p-type transistor is turned on, and a rapid rise time results due to the p-type transistor's larger size. However, when the gate pulse transitions from high to low, the n-type transistor is turned on, and a smooth, slower fall time results due to the n-type transistor's smaller size.

This approach has several drawbacks. The negative slew rate that results from the patented method is strongly dependent on several factors, including the fabrication technology used, process variations, temperature drift, and the supply voltage. In addition, when implemented as shown in FIG. 2 of the patent, the gate pulse can only swing between ground and the supply voltage; no other steady-state voltages are possible.

SUMMARY OF THE INVENTION

A dual voltage switch with programmable asymmetric transfer rate is presented. The present switch enables the generation of a pulse for which the transfer rates—i.e., the pulse's positive and/or negative slew rates—are programmable by means of a user-provided capacitance.

A user provides first and second input voltages (V1 and V2), between which the pulse toggles in response to a user-provided control signal. The dual voltage switch includes a first switch, a second switch, a capacitance and a control circuit. The first switch conducts a current I1 between voltage V1 and a common output node in response to a first control voltage. Similarly, the second switch conducts a current I2 between voltage V2 and the common output node in response to a second control voltage. In response to a user-provided control signal which determines which of input voltages V1 and V2 is to be passed onto the common output node, the control circuit alternately provides the first and second control voltages so that the common output node is pulled up to voltage V1 at a transfer rate given by I1/C when the first control voltage is provided, and is pulled down to voltage V2 at a transfer rate given by −I2/C when the second control voltage is provided. Thus, properly selecting the first and second control voltages and C enables the pulse's positive and negative slew rates to be controlled.

The present switch is suitably employed in an active matrix liquid crystal display, to provide gate pulses with user-programmable slew rates which are largely independent of process technology or temperature variations. The switch is suitably realized as an integrated circuit (IC).

Further features and advantages of the invention will be apparent to those skilled in the art from the following detailed description, taken together with the accompanying drawings.

DETAILED DESCRIPTION OF THE INVENTION

Figure 1A:
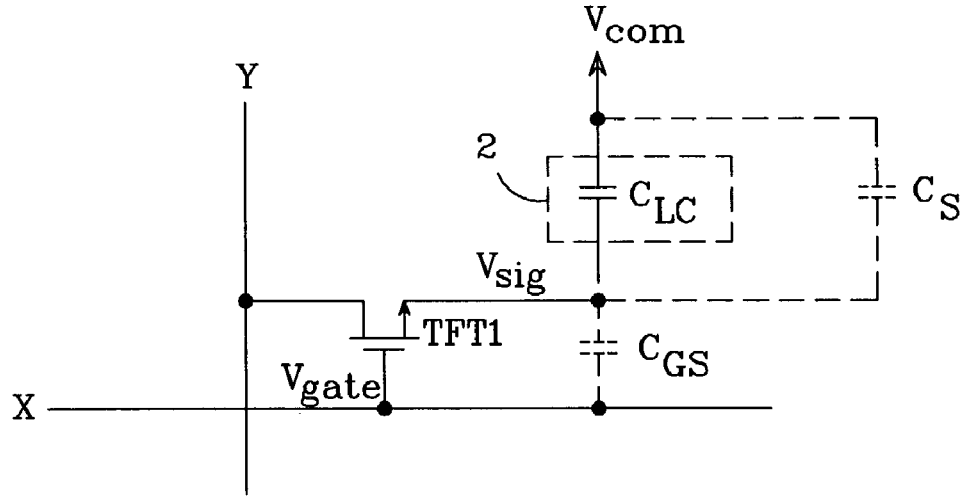
FIG.1a (Prior Art)
FIG. 1*a* is a schematic diagram of a known active matrix LCD pixel.
Figure 1B:
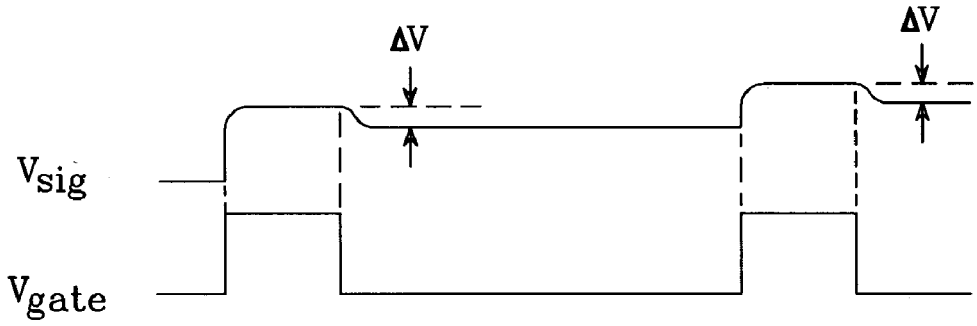
FIG.1b (Prior Art)
FIG. 1*b* is a timing diagram illustrating the operation of the pixel shown in FIG. 1*a*.
Figure 2A:
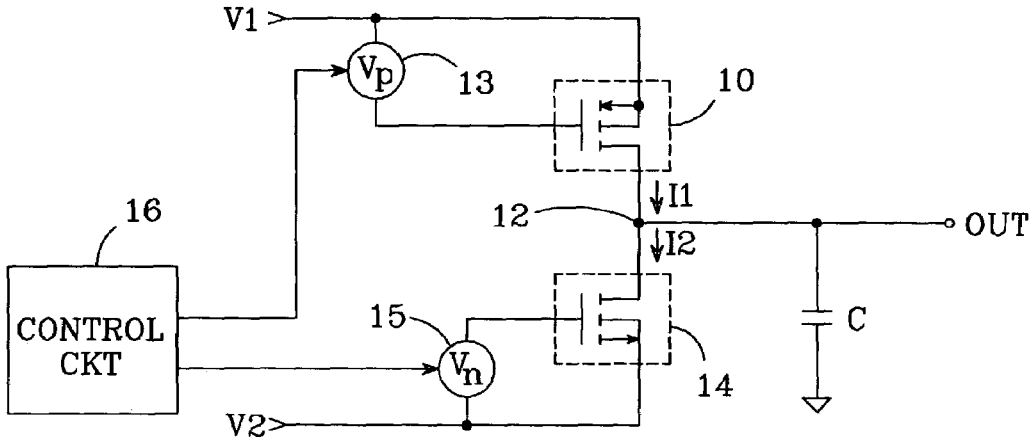
FIG. 2*a* is a schematic/block diagram of a dual voltage switch with programmable asymmetric transfer rate in accordance with the present invention.

The basic principles of a dual voltage switch with programmable asymmetric transfer rate in accordance with the present invention are illustrated in FIG. 2*a*. A first switch 10 is connected between a first input voltage V1 and a common output node 12, and a second switch 14 is connected between a second input voltage V2 and common output node 12. V1 and V2 are typically provided by a user of the switch, which is suitably realized as an IC.

Switch 10 is arranged to conduct a first current I1 between V1 and common output node 12 in response to a control voltage $V_p$ provided by a controllable voltage source 13, and switch 14 is arranged to conduct a second current I2 between V2 and common output node 12 in response to a control voltage $V_n$ produced by a controllable voltage source 15. Switches 10 and 14 are arranged such that their respective resistances—and thus currents I1 and I2—vary in response to control voltages $V_p$ and $V_n$, respectively. A load capacitance C is connected between common output node 12 and a fixed potential such as ground.

Figure 2B:
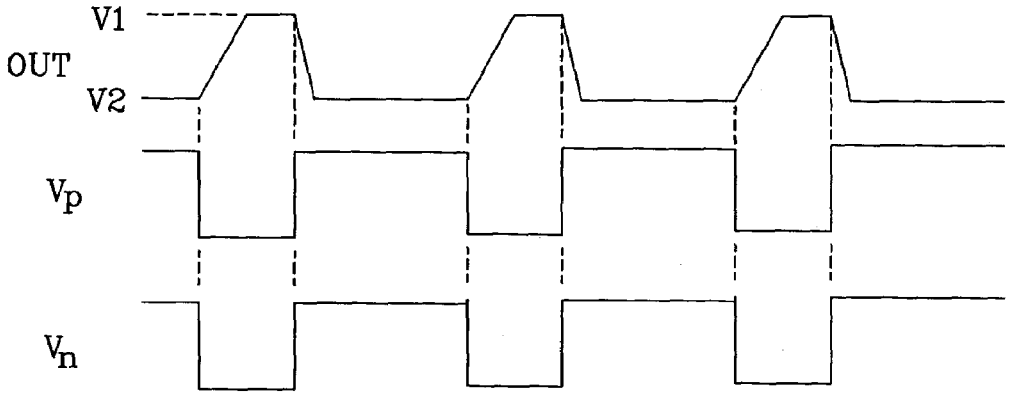
FIG. 2*b* is a timing diagram illustrating the operation of the switch shown in FIG. 2*a*.

In operation, a control circuit 16 alternately causes $V_p$ and $V_n$ to be provided in order to cause switches 10 and 14 to conduct their respective currents to produce a pulse at common output node 12 (OUT) which toggles between V1 and V2. The operation of the switch shown in FIG. 2*a* is illustrated with reference to the timing diagram shown in FIG. 2*b*. In the exemplary embodiment shown in FIG. 2*a*, switches 10 and 14 are shown implemented with a PMOS field-effect transistor (FET) and an NMOS FET, respectively. Control voltage $V_p$ toggles between a high state sufficient to keep the FET of switch 10 turned off, and a low state which applies a voltage sufficient to turn on the FET of switch 10 in order to achieve a desired resistance and conduct current I1. Similarly, $V_n$ toggles between a low state sufficient to keep switch 14 turned off, and a high state which applies a voltage sufficient to turn on switch 14 to achieve a desired resistance and conduct current I2.

Thus, when $V_n$ and $V_p$ toggle low, switch 14 is turned off and switch 10 conducts I1 to common node 12. Switch 10 acts as a constant current source, such that capacitance C is charged until OUT=V1, with the voltage at common node 12 increasing to V1 at a slew rate SR given by:

$$SR1=I1/C.$$

When $V_n$ and $V_p$ toggle high, switch 12 is turned off and switch 14 conducts I2 to common node 12. Switch 14 acts as a constant current sink, such that C is discharged until OUT=V1, with the voltage at common node 12 decreasing to OUT=V2 at a slew rate given by:

$$SR2=-I2/C.$$

In this way, a pulse is generated at OUT. By properly selecting $V_p$, $V_n$ and C, desired positive and negative slew rates can be achieved, including asymmetric transfer rates if SR1 SR2. If needed, the ratio between the positive and negative slew rates can be adjusted by changing the relative values of control voltages $V_p$ and $V_n$.

Typically, $V_p$ and $V_n$—and thus I1 and I2—are fixed and known. When so arranged, the positive and negative slew rates are fixed for a given capacitance; i.e., user-provided capacitance C sets the pulse's positive and negative slew rates. When I1 and I2 are fixed, so is the ratio between the positive and negative slew rates. Changing the value of C increases or decreases both slew rates, but the ratio between them remains fixed.

Capacitance C can be an actual capacitor, the capacitance presented by the circuitry driven by the output pulse, or a combination of both. For example, if OUT is connected to drive an array of TFTs driving an LCD display, the array has an associated inherent capacitance that may be used to establish the slew rates as described above. In this case, currents I1 and I2 should be selected such that, when driving the inherent capacitance, the desired slew rates are achieved.

The switch provides additional advantages when implemented as an IC. As noted above, the slew rate of the generated pulse can be adjusted by the user by simply changing the value of capacitance C; this means that there is no need for an additional adjustment pin to provide this functionality. If the currents are set for some maximum value of slew rate when driving the capacitance of, for example, an active matrix LCD address line, then the slew rate can be reduced by the addition of a discrete capacitor to the line.

Figure 3A:
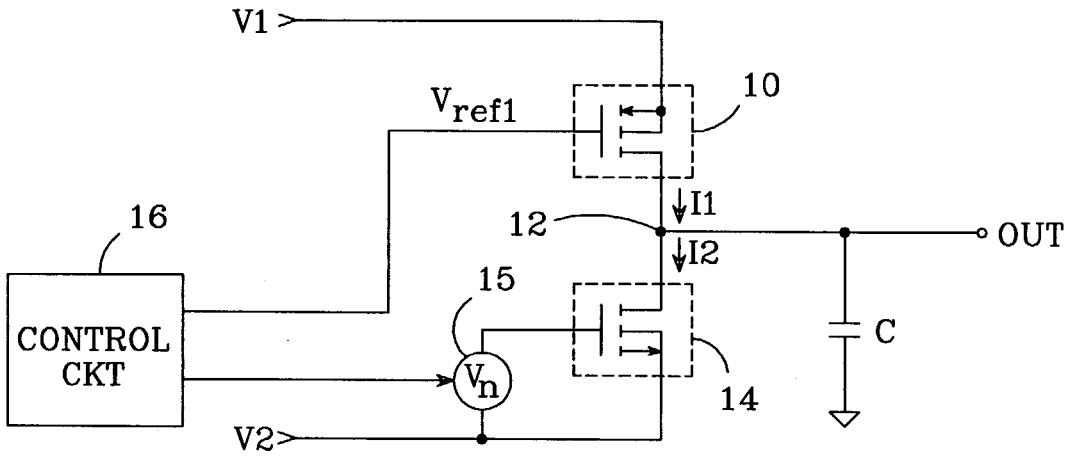
FIG. 3*a* is a schematic/block diagram of another possible embodiment of a dual voltage switch with programmable asymmetric transfer rate in accordance with the present invention.
Figure 3B:
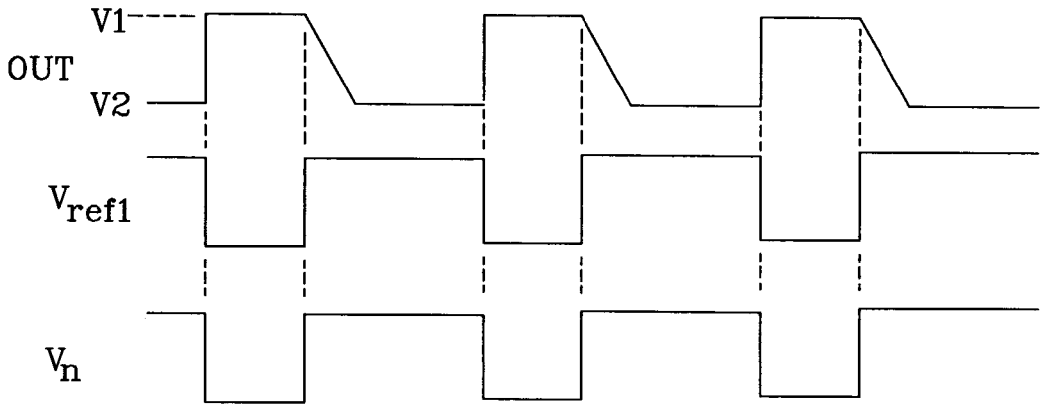
FIG. 3*b* is a timing diagram illustrating the operation of the switch shown in FIG. 3*a*.

FIGS. 3*a* and 3*b* illustrate another possible configuration for the present switch. In many cases, such as the active matrix LCD device discussed above, there is only an interest in controlling the negative slew rate. In FIG. 3*a*, switch 10 is driven with a voltage $V_{ref1}$, which is selected such that, when applied, switch 10 is turned fully on and presents a very low resistance between V1 and common node 12, thereby making current I1 a large current. As shown in the timing diagram shown in FIG. 3*b*, this large I1 current charges C nearly instantaneously, such that common output node 12 is pulled up to V1 in a very short time.

Control voltage $V_n$, on the other hand, is selected such that switch 14 operates as a constant current sink, with the negative slew rate set to −I2/C as described above. In this way, a pulse having a very short rise time and a controlled negative slew rate is achieved, which can be used, for example, to drive the TFTs of an LCD display as described above.

Adding capacitance to common output node 12 changes both the positive and negative transfer rates. However, when current I1 is made large, as in this example, the pulse's rise time is likely to be negligibly fast for all useful values of capacitance controlling the current-limited fall time.

Figure 4A:
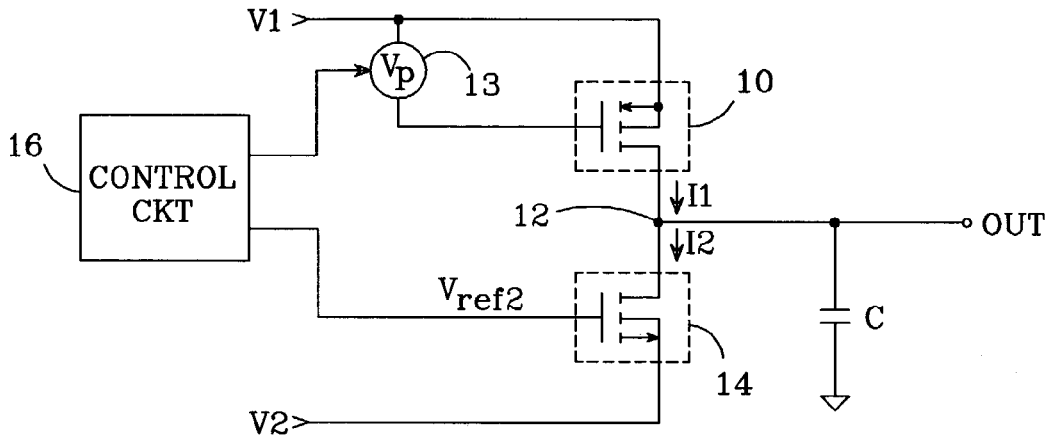
FIG. 4*a* is a schematic/block diagram of another possible embodiment of a dual voltage switch with programmable asymmetric transfer rate in accordance with the present invention.
Figure 4B:
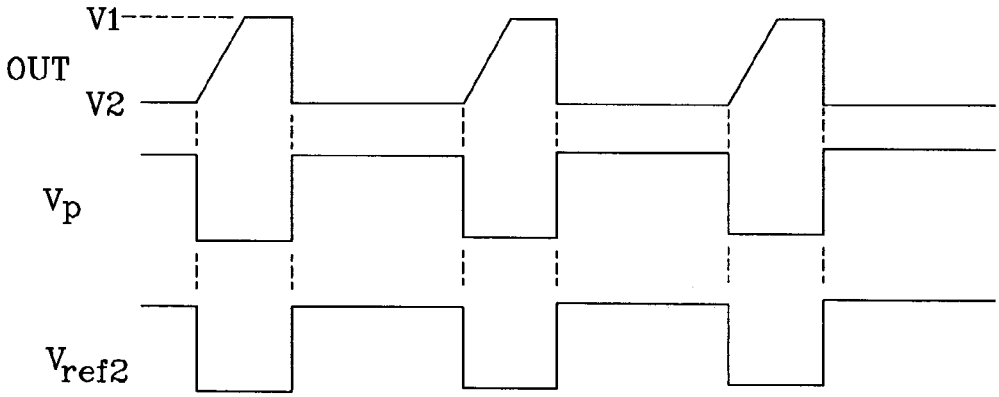
FIG. 4*b* is a timing diagram illustrating the operation of the switch shown in FIG. 4*a*.

Another possible configuration is illustrated in FIGS. 4*a* and 4*b*. Here, switch 14 is driven with a voltage $V_{ref2}$, which is selected such that, when applied, switch 14 is turned fully on and presents a very low resistance between V2 and common node 12. This makes current I2 large, so that capacitance C is rapidly discharged and common node 12 is pulled down to V2 in a very short time.

Control voltage $V_p$, on the other hand, is selected such that switch 10 operates as a constant current source, with the positive slew rate set to I1/C as described above. In this way, a pulse having a very short fall time and a controlled positive slew rate is achieved.

It is not essential that switches 10 and 14 be complementary FETs, as depicted in FIGS. 2*a*–4*a*. Any device capable of conducting a current which varies with an applied control voltage might be used. For example, complementary bipolar transistors could be suitably employed as switches 10 and 14.

Figure 5:
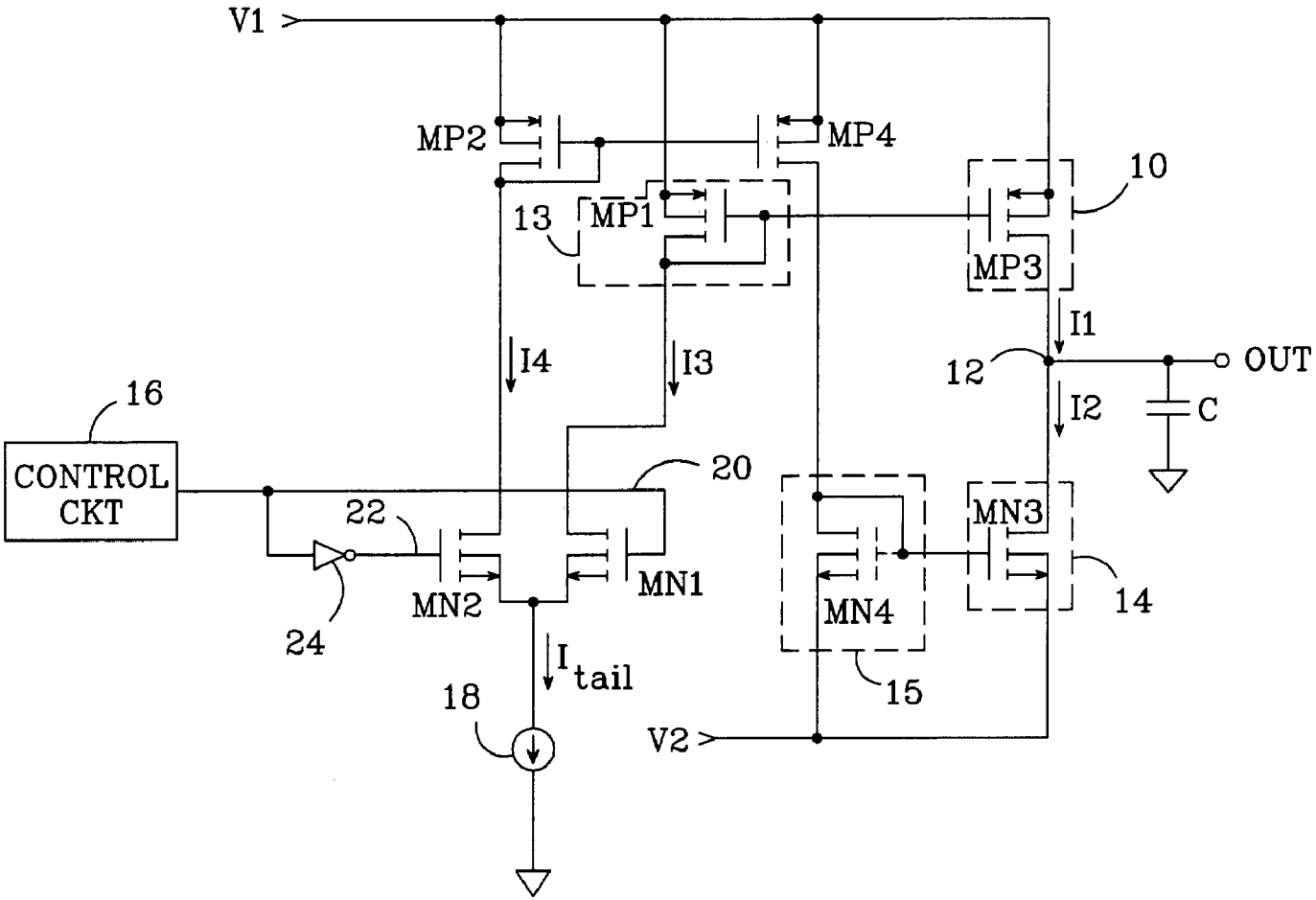
FIG. 5 is a schematic diagram illustrating one possible implementation of a dual voltage switch with programmable asymmetric transfer rate in accordance with the present invention.

One possible implementation of a dual voltage switch with programmable asymmetric transfer rate in accordance with the present invention is shown in FIG. 5. A pair of FETs MN1 and MN2 are biased with a tail current $I_{tail}$ provided by a current source 18, and are preferably operated with complementary control signals 20 and 22, respectively. Control signals 20 and 22 are produced, for example, by control circuit 16 and an inverter 24. MN1 and MN2 are connected to input voltage V1 through diode-connected FETs MP1 and MP2, respectively. MN1 and MN2 are operated as switches: when control signal 20 is high, MN1 is turned on and conducts a current I3 (=$I_{tail}$) through MP1, and when control signal 22 is high, MN2 is turned on and conducts a current I4 (=$I_{tail}$) through MP2.

Switches 10 and 14 are implemented with a PMOS FET MP3 and an NMOS FET MN3, respectively. As before, a capacitance C is connected to common output node 12. Here, FET MP1 when driven by I3 comprise controllable voltage source 13. Diode-connected FET MP1 is connected to form a current mirror with PMOS FET MP3; as such, the voltage across MP1 causes MP3 to operate at a controlled current. Thus, when MN1 is turned on by control signal 20, current I3 is mirrored to MP3, which in response conducts current I1 to common node 12, charging capacitance C and pulling node 12 up to V1.

Diode-connected FET MP2 forms a current mirror with a FET MP4, which mirrors current I4 to a diode-connected FET MN4; when driven by the mirrored I4 current, MN4 comprises controllable voltage source 15. MN4 is connected to form a current mirror with NMOS FET MN3 such that the voltage across MN4 causes MN3 to operate at a controlled current. Thus, the MP2/MP4 mirror reflects I4 to the MN4/MN3 mirror, which causes I2 to be conducted to common node 12, discharging capacitance C and pulling node 12 down to V2.

MN1 and MN2 are arranged such that, when MN1 is turned on and I1 is being conducted, MN2 is off and thus I4 and I2 are zero. Similarly, when MN2 is turned on and I2 is being conducted, MN1 is off and thus I3 and I1 are zero. This is preferably achieved with complementary control signals 20 and 22 as shown in FIG. 5. However, it is not essential that MN1 and MN2 be operated with complementary control signals. For example, the gate of MN2 could be connected to a fixed voltage equal to half the logic swing of control signal 20, and MN1 and MN2 would still be alternately turned on and off by signal 20 as before. However, the noise immunity for this arrangement would be half of that of the circuit shown.

Currents I1 and I2 may be established by properly selecting the value of $I_{tail}$ and the current mirror ratios. Current mirror ratios are established by using transistors of different sizes. For example, first and second FETs making up a current mirror have respective sizes, which are typically specified in terms of their width/length ratios; i.e., $(W/L)_1$ and $(W/L)_2$. A desired current mirror ratio is then established by properly selecting the ratio of $(W/L)_1$ to $(W/L)_2$. Generally, a fixed length is used and the widths are varied to set the ratio. When MN1 is turned on, I1 is given by:

$$I1=I_{tail}*((W/L)_{MP3}:(W/L)_{MP1})$$

where $(W/L)_{MP3}$: $(W/L)_{MP1}$ is the ratio of $(W/L)_{MP3}$ to $(W/L)_{MP1}$. For example, if $I_{tail}$=10 $\mu$a and $(W/L)_{MP3}$: $(W/L)_{MP1}$=2, I1 will be 20 $\mu$a when MN1 is turned on. Then, if C=10 pF, the positive slew rate is equal to 20 $\mu$a/10 pF=2 v/psec.

When MN2 is turned on, I2 is given by:

$$I2=I_{tail}*((W/L)_{MP4}:(W/L)_{MP2})*((W/L)_{MN3}:(W/L)_{MN4}))$$

For example, if $I_{tail}$=10 $\mu$a, $(W/L)_{MP4}$: $(W/L)_{MP2}$=2, and $(W/L)_{MN3}$: $(W/L)_{MN4}$=2, I2 will be 40 $\mu$a when MN2 is turned on. Then, if C=10 pF, the positive slew rate is equal to 40 $\mu$a/10 pF=4 v/psec.

When MN1 is turned on, MP3 acts as a constant current source which results in capacitance C accumulating a total charge of V1*C (assuming the bottom plate of the capacitance is connected to ground potential). When MN2 is turned on, MN3 acts as a constant current sink such that OUT is lowered towards V2 at a constant rate. MN3 operates in its saturation region during most of OUT's fall time. While in saturation, MN3's drain current is largely independent of its drain-to-source voltage (VDS), such that OUT falls at a nearly constant rate. However, as OUT gets close to V2, MN3 begins operating in its triode region. Here, drain current decreases with VDS until the current flow into MN3 stops completely, so that OUT rolls-off to provide a fairly soft transition between the falling portion and the horizontal portion of its waveform.

Though not essential to the invention, the present dual voltage switch is suitably realized as an IC. This enables the current mirror ratios to be accurate and predictable due to the well-matched monolithic transistors achievable on a single die. In addition, IC technology permits the generation of currents, such as tail current $I_{tail}$, for example, with more repeatability than the MOS characteristics relied upon by prior art methods. Furthermore, the sensitivity of generated currents to supply voltage can be made near zero in an IC, as contrasted with the square law supply voltage sensitivity of prior art circuits.

Figure 6:
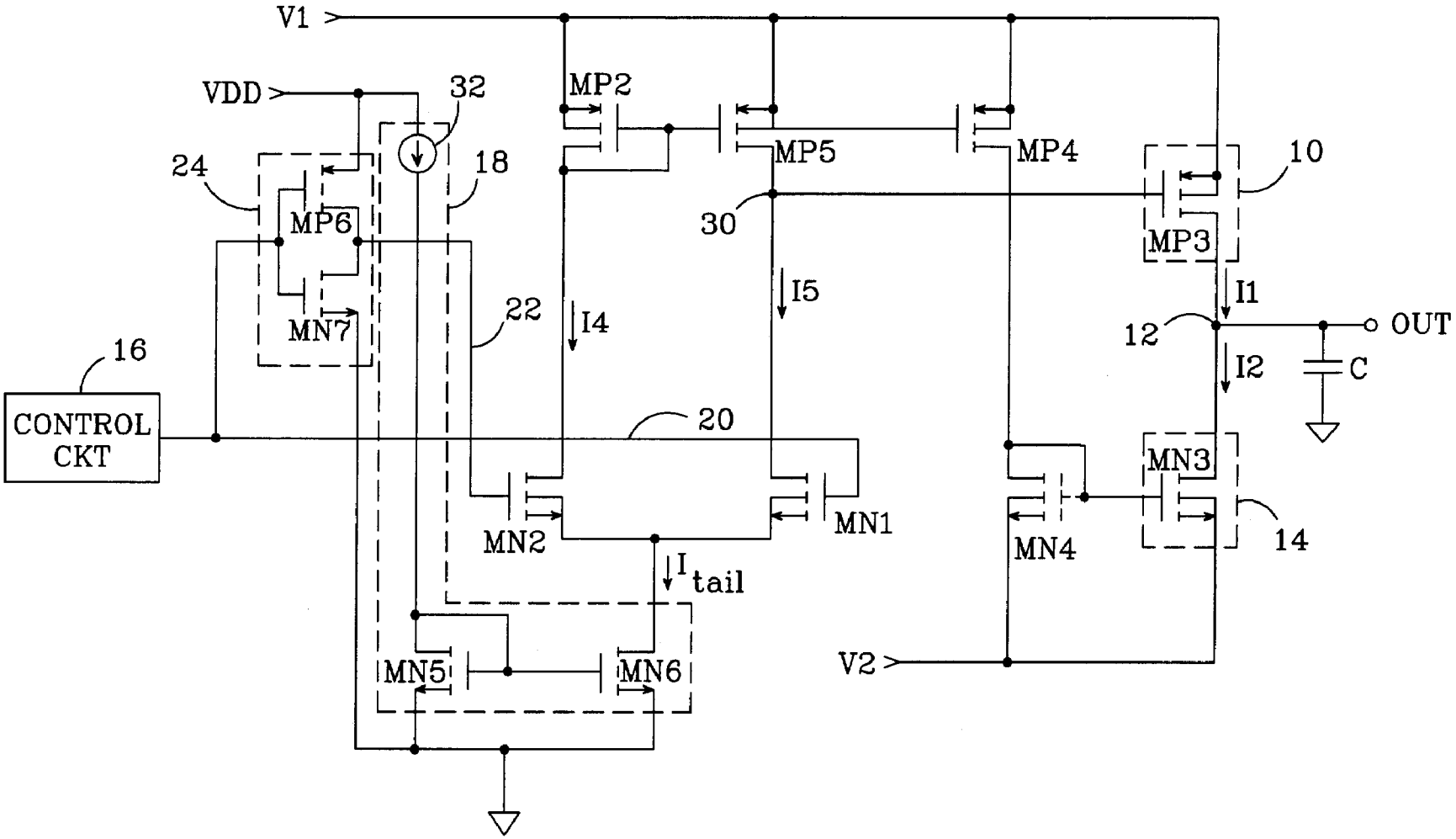
FIG. 6 is a schematic diagram illustrating another possible implementation of a dual voltage switch with programmable asymmetric transfer rate in accordance with the present invention.

Another possible implementation of a dual voltage switch with programmable asymmetric transfer rate in accordance with the present invention is shown in FIG. 6. In this exemplary arrangement, the output pulse's positive slew rate is made as quick as possible, while the negative slew rate is controlled.

As in FIG. 5, switches 10 and 14 are implemented with a PMOS FET MP3 and an NMOS FET MN3, respectively. FETs MN1 and MN2 are biased with tail current $I_{tail}$, and are preferably operated with complementary control signals 20 and 22, respectively. MN2 is connected to input voltage V1 through diode-connected FET MP2, and conducts a current I4 (=$I_{tail}$) when MN2 is turned on. MP2 forms a current mirror with FET MP4, which is connected to mirror current I4 to diode-connected FET MN4 which is connected to form a current mirror with NMOS FET MN3. Thus, the MP2/

MP4 mirror reflects I4 to the MN4/MN3 mirror, which causes I2 to be conducted to common node 12, discharging capacitance C and pulling node 12 down to V2.

In this implementation, MN1 is connected to input voltage V1 through a FET MP5 which forms a current mirror with MP2. The junction of MN1 and MP5 is a node 30, which is connected to drive MP3. Here, when MN1 is turned on, it conducts a current I5 (=$I_{tail}$) through MP5, which pulls node 30 and the gate of MP3 toward ground. This turns MP3 fully on and I1 is conducted to common node 12. With MP3 fully on, its resistance is low and I1 is large; as a result, node 12 is quickly pulled up to voltage V1. The positive slew rate is still given by I1/C; however with I1 so large, the positive slew rate is negligibly fast for all useful values of C.

Thus, with the implementation shown in FIG. 6, the output pulse's positive slew rate is very high, while negative slew rate is controlled and given by −I2*C. As above, I2 given by:

$$I2=I_{tail}*((W/L)_{MP4}:(W/L)_{MP2})*((W/L)_{MN3}:(W/L)_{MN4})$$

As in FIG. 5, MN1 and MN2 are arranged such that when MN1 is turned on and I1 is being conducted, MN2 is off and I4 and I2 are zero. Similarly, when MN2 is turned on and I2 is being conducted, MN1 is off and thus I3 and I1 are zero.

FIG. 6 also illustrates possible implementations for current source 18 and inverter 24. Current source 18 is suitably implemented with a current source 32 and a current mirror formed from a pair of FETs MN5 and MN6. The output of current source 32 is mirrored to FETs MN1 and MN2 via MN5 and MN6, thereby providing $I_{tail}$. Note that $I_{tail}$ may be provided in any number of other ways as well; methods of providing a reproducible current are well known in the art.

Inverter 24 is suitably implemented with a pair of FETs MP6 and MN7, connected in a conventional inverter arrangement. When control circuit 16 toggles control signal 20 high, the output of inverter 24 and thus control signal 22 goes low; when control signal 20 goes low, the output of inverter 24 and control signal 22 go high. Note that there are many other ways in which inverter 24 might be implemented. Furthermore, as noted above in relation to FIG. 5, it is not essential that an inverter be provided at all—it is only necessary that a mechanism be provided to operate switches 10 and 14 such that the transfer rates of the resulting output pulse can differ.

Though not shown, FIG. 5 or 6 could be modified to provide an implementation which makes the output pulse's positive slew rate controllable, with negative slew rate being as quick as possible.

The implementation shown in FIG. 5 would be preferred if both positive and negative slew rate are to be controlled. The implementation shown in FIG. 6 would be preferred if only negative slew rate is to be controlled.

It is not essential that the circuitry which operates switches 10 and 14 be implemented with FETs. For example, bipolar implementations could be achieved by replacing all of the FETs shown in FIGS. 5 and 6 with bipolar transistors having the same polarities as the FETs they replace.

Figure 7A:
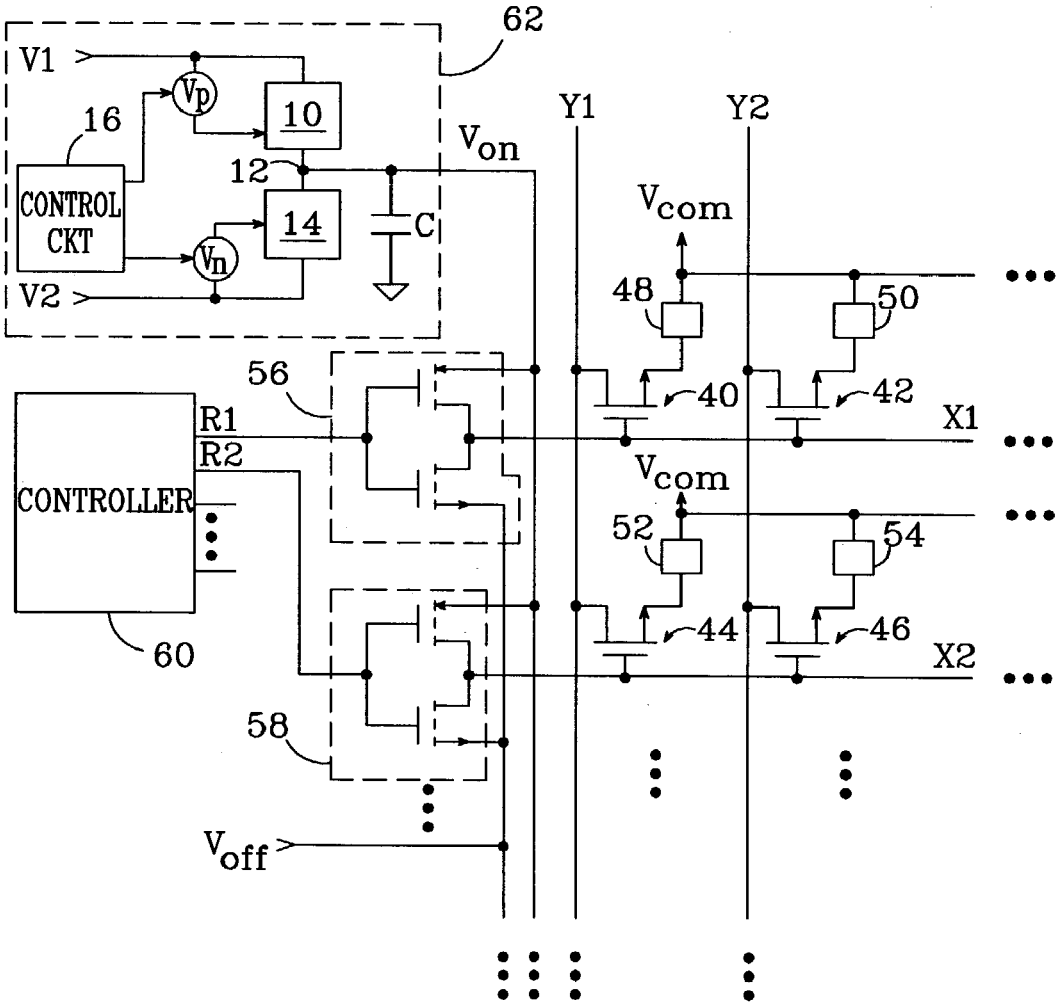
FIG. 7 is a schematic/block diagram of an active matrix LCD display which employs the present dual voltage switch with programmable asymmetric transfer rate.

One possible application of a dual voltage switch in accordance with the present invention is shown in FIG. 7*a*. Here, the present dual voltage switch is used to provide the gate turn-on pulses for the transistors of an active matrix LCD display. As shown in FIG. 7, each pixel location includes a transistor (40, 42, 44, 46) which drives a pixel (48, 50, 52, 54). Each transistor is connected between a column line (Y1, Y2, . . . ) and a pixel, and is turned on in response to a pulse applied to its gate via a gate line (X1, X2, . . . ). The row lines are connected to the outputs of respective inverters (56, 58), which are operated with respective control signals (R1, R2) output by a controller 60.

A dual voltage switch 62 per the present invention provides the "on" voltage ($V_{on}$) to the row transistors, and a second voltage ($V_{off}$) provides the transistors' "off" voltage. $V_{on}$ and $V_{off}$ are connected to respective inverter transistors such that $V_{on}$ is connected to a row line when the inverter's upper transistor is on, and $V_{off}$ is connected to a row line when the inverter's lower transistor is on.

Figure 7B:
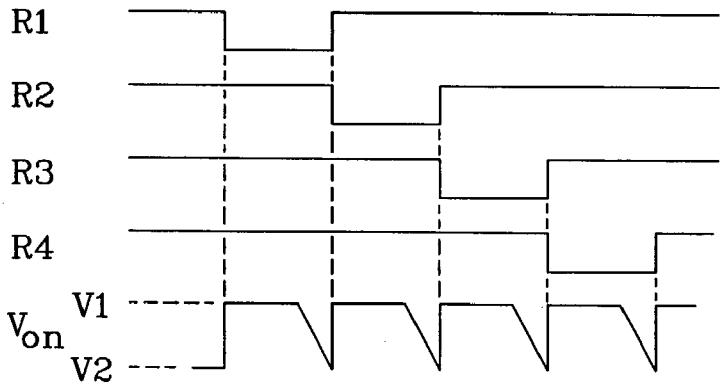

Operation of the display is illustrated in FIG. 7*b*. Controller 60 outputs control signals R1, R2, etc. so as to turn on the upper transistors of each inverter—and thereby address each row—in sequence. For example, inverter 56 connects $V_{on}$ to row line X1 when control signal R1 toggles low, and connects $V_{off}$ to X1 when R1 toggles high. Similarly, inverter 58 connects $V_{on}$ to row line X2 when control signal R2 toggles low, and connects $V_{off}$ to X2 when R2 toggles high. Dual voltage switch 62 is arranged to provide a gate turn-on pulse during the time that each row is enabled.

$V_{off}$ is fixed, typically at a negative voltage, such that each row's transistors are completely turned off when the row is disabled. The gate pulse $V_{on}$ is typically arranged to slew from V2 to V1 and back down to V2 within each row's enable period, though other arrangements are possible and might be preferable in some cases. $V_{on}$'s transfer rates are programmable as discussed above, and thus can be adjusted as necessary to meet the requirements of a particular application.

Note that the implementation of an active matrix LCD display shown in FIG. 7*a* is merely exemplary; many other arrangements are possible. Further note that the application shown in FIG. 7*a* is just one of many possible uses for the present dual voltage switch. The present switch is useful whenever the generation of a pulse with an asymmetric transfer rate is required or beneficial.

While particular embodiments of the invention have been shown and described, numerous variations and alternate embodiments will occur to those skilled in the art. Accordingly, it is intended that the invention be limited only in terms of the appended claims.

What is claimed is:

1. A dual voltage switch with programmable asymmetric transfer rate, comprising:

a first input voltage V1, a second input voltage V2, a first switch connected to conduct a first current I1 between V1 and a common output node in response to a first control voltage with which the resistance of said first switch varies, a second switch connected to conduct a second current I2 between V2 and said common output node in response to a second control voltage with which the resistance of said second switch varies, a load capacitance C connected to said common output node, and a control circuit arranged to alternately provide said first and second control voltages such that said common output node is pulled up to V1 at a first transfer rate given by I1/C when said first control voltage is provided and said common output node is pulled down to V2 at a second transfer rate given by −I2/C when said second control voltage is provided.

2. The dual voltage switch of claim 1, wherein said first control voltage, when provided, is sufficient to reduce the resistance of said first switch to nearly zero such that said first transfer rate is substantially instantaneous.

3. The dual voltage switch of claim 1, wherein said second control voltage, when provided, is sufficient to reduce the resistance of said second switch to nearly zero such that said second transfer rate is substantially instantaneous.

4. The dual voltage switch of claim 1, further comprising circuitry connected to said common node, wherein said load capacitance C is the inherent capacitance of said circuitry connected to said common output node.

5. The dual voltage switch of claim 4, wherein said first and second control voltages are selected to establish currents I1 and I2 to provide desired first and second transfer rates when said load capacitance C is the inherent capacitance of said circuitry connected to said common output node.

6. The dual voltage switch of claim 1, wherein said first and second switches are complementary field-effect transistors (FETs), each of which, in response to the providing of said first and second control voltages, respectively, operates predominately in its saturation region such that said transfer rates are substantially constant.

7. The dual voltage switch of claim 1, wherein said first and second control voltages are selected to establish currents I1 and I2 to provide a desired ratio between said first and second transfer rates.

8. The dual voltage switch of claim 1, wherein said first and second switches are first and second complementary transistors (MP3,MN3) and said control circuit comprises:

at least one control signal which toggles between first and second states, third (MN1) and fourth (MN2) transistors biased with a common tail current $I_{tail}$, said third transistor connected to conduct a third current I3 when said at least one control signal is in said first state and said fourth transistor connected to conduct a fourth current I4 when said at least one control signal is in said second state, a first diode-connected transistor (MP1) connected to form a first current mirror with said first transistor such that I3 is mirrored to said first transistor such that I1 varies with I3, a second diode-connected transistor (MN4) connected to form a second current mirror with said second transistor, and a third current mirror (MP2/MP4) connected to mirror I4 to said second diode-connected transistor such that I4 is mirrored to said second transistor via said third current mirror such that I2 varies with I4, such that said first control voltage is provided to said first switch when said at least one control signal is in said first state and said second control voltage is provided to said second switch when said at least one control signal is in said second state.

9. The dual voltage switch of claim 8, wherein said first current mirror has a ratio of x such that I1 is given by $I_{tail}$*x when said at least one control signal is in said first state.

10. The dual voltage switch of claim 8, wherein said third current mirror has a ratio of x and said second current mirror has a ratio of y such that I2 is given by $I_{tail}$*x*y when said at least one control signal is in said second state.

11. The dual voltage switch of claim 8, wherein said at least one control signal comprises first and second complementary control signals which toggle between said first and second states and are connected to drive said third and fourth transistors, respectively.

12. The dual voltage switch of claim 1, wherein said first and second switches are first and second complementary transistors (MP3,MN3) and said control circuit comprises:

at least one control signal which toggles between first and second states, third (MN1) and fourth (MN2) transistors biased with a common tail current $I_{tail}$, said third transistor connected to conduct a third current I3 (I5) when said at least one control signal is in said first state and said fourth transistor connected to conduct a fourth current I4 (I4) when said at least one control signal is in said second state, a first diode-connected transistor (MP2) connected between input voltage V1 and said fourth transistor, a fifth transistor (MP5) connected between V1 and said third transistor, the control inputs of said first diode-connected transistor and said fifth transistor connected together to form a first current mirror, the junction (30) of said fifth transistor and said third transistor connected to the control input of said first transistor, a sixth transistor (MP4), and a second diode-connected transistor (MN4) connected to form a second current mirror with said second transistor, said sixth transistor connected between V1 and said second diode-connected transistor, the control inputs of said first diode-connected transistor and said sixth transistor connected together to form a third current mirror which mirrors I4 to said second current mirror such that I2 varies with I4, such that said first control voltage is provided to said first switch when said at least one control signal is in said first state and said second control voltage is provided to said second switch when said at least one control signal is in said second state.

13. The dual voltage switch of claim 12, wherein said third current mirror has a ratio of x and said second current mirror has a ratio of y such that I2 is given by $I_{tail}$*x*y when said at least one control signal is in said second state.

14. The dual voltage switch of claim 12, wherein said third and fourth transistors and said first current mirror are arranged such that, when said at least one control signal is in said first state, the voltage at said junction is sufficient to reduce the resistance of said first switch to nearly zero such that said first transfer rate is substantially instantaneous.

15. The dual voltage switch of claim 12, wherein said at least one control signal comprises first and second complementary control signals which toggle between said first and second states and are connected to drive said third and fourth transistors, respectively.

16. A dual voltage switch with programmable asymmetric transfer rate, comprising:

a first input voltage V1, a second input voltage V2, a first transistor connected to conduct a first current I1 between V1 and a common output node in response to a first control voltage with which the resistance of said first transistor varies, a second transistor complementary to said first transistor connected to conduct a second current I2 between V2 and said common output node in response to a second control voltage with which the resistance of said second switch varies, a load capacitance C connected to said common output node, and a control circuit arranged to alternately provide said first and second control voltages such that said common output node is pulled up to V1 at a first transfer rate given by I1/C when said first control voltage is provided and said common output node is pulled down to V2 at a second transfer rate given by −I2/C when said second control voltage is provided, said control circuit comprising:

at least one control signal which toggles between first and second states, third and fourth transistors biased with a common tail current $I_{tail}$, said third transistor connected to conduct a third current I3 when said at least one control signal is in said first state and said fourth transistor connected to conduct a fourth current I4 when said at least one control signal is in said second state, a first diode-connected transistor connected to form a first current mirror with said first transistor such that I3 is mirrored to said first transistor such that I1 varies with I3, a second diode-connected transistor connected to form a second current mirror with said second transistor, and a third current mirror connected to mirror I4 to said second diode-connected transistor such that I4 is mirrored to said second transistor via said third current mirror such that I2 varies with I4, such that said first control voltage is provided to said first transistor when said at least one control signal is in said first state and said second control voltage is provided to said second transistor when said at least one control signal is in said second state.

17. The dual voltage switch of claim 16, wherein said first current mirror has a ratio of x such that I1 is given by $I_{tail}$*x when said at least one control signal is in said first state.

18. The dual voltage switch of claim 16, wherein said third current mirror has a ratio of x and said second current mirror has a ratio of y such that I2 is given by $I_{tail}$*x*y when said at least one control signal is in said second state.

19. The dual voltage switch of claim 16, wherein said first and second transistors are complementary field-effect transistors (FETs), each of which, in response to the providing of said first and second control voltages, respectively, operates predominately in its saturation region such that said transfer rates are substantially constant.

20. The dual voltage switch of claim 16, wherein said dual voltage switch is integrated on a common substrate.

21. A dual voltage switch with programmable asymmetric transfer rate, comprising:

a first input voltage V1, a second input voltage V2, a first transistor connected to conduct a first current I1 between V1 and a common output node in response to a first control voltage with which the resistance of said first transistor varies, a second transistor complementary to said first transistor connected to conduct a second current I2 between V2 and said common output node in response to a second control voltage with which the resistance of said second transistor varies, a load capacitance C connected to said common output node, and a control circuit arranged to alternately provide said first and second control voltages such that said common output node is pulled up to V1 at a first transfer rate given by I1/C when said first control voltage is provided and said common output node is pulled down to V2 at a second transfer rate given by −I2/C when said second control voltage is provided, said control circuit comprising:

at least one control signal which toggles between first and second states, third and fourth transistors biased with a common tail current $I_{tail}$, said third transistor connected to conduct a third current I3 when said at least one control signal is in said first state and said fourth transistor connected to conduct a fourth current I4 when said at least one control signal is in said second state, a first diode-connected transistor connected between V1 and said fourth transistor, a fifth transistor connected between V1 and said third transistor, the control inputs of said first diode-connected transistor and said fifth transistor connected together to form a first current mirror, the junction of said fifth transistor and said third transistor connected to the control input of said first transistor, a sixth transistor, a second diode-connected transistor connected to form a second current mirror with said second transistor, and said sixth transistor connected between V1 and said second diode-connected transistor, the control inputs of said first diode-connected transistor and said sixth transistor connected together to form a third current mirror which mirrors I4 to said second current mirror such that I2 varies with I4, such that said first control voltage is provided to said first transistor when said at least one control signal is in said first state and said second control voltage is provided to said second transistor when said at least one control signal is in said second state.

22. The dual voltage switch of claim 21, wherein said third current mirror has a ratio of x and said second current mirror has a ratio of y such that I2 is given by $I_{tail}$*x*y when said at least one control signal is in said second state.

23. The dual voltage switch of claim 21, wherein said third and fourth transistors and said first current mirror are arranged such that, when said at least one control signal is in said first state, the voltage at said junction is sufficient to reduce the resistance of said first switch to nearly zero such that said first transfer rate is substantially instantaneous.

24. The dual voltage switch of claim 21, wherein said first and second transistors are complementary field-effect transistors (FETs), each of which, in response to the providing of said first and second control voltages, respectively, operates predominately in its saturation region such that said transfer rates are substantially constant.

25. The dual voltage switch of claim 21, wherein said dual voltage switch is integrated on a common substrate.

26. An active matrix liquid crystal display (LCD), comprising:

a plurality of LCD pixels arranged into a row and column array, each of said rows having an associated row line and each of said columns having an associated column line, a plurality of transistors connected to respective ones of said LCD pixels, each of said transistors arranged to connect its pixel to said pixel's column line in response to a turn-on voltage $V_{on}$ applied to said pixel's row line, a plurality of inverters connected to respective ones of said row lines, each of said inverters arranged to connect voltage $V_{on}$ to said row line when said row line is enabled and to connect a voltage $V_{off}$ to said row line when said row line is disabled, a controller arranged to operate said inverters such that said row lines are enabled in a predetermined sequence, and a dual voltage switch with programmable asymmetric transfer rate, comprising:

a first input voltage V1, a second input voltage V2, a first switch connected to conduct a first current I1 between V1 and a common output node in response to a first control voltage with which the resistance of said first switch varies, a second switch connected to conduct a second current I2 between V2 and said common output node in response to a second control voltage with which the resistance of said second switch varies, a load capacitance C connected to said common output node, and a control circuit arranged to alternately provide said first and second control voltages such that said common output node is pulled up to V1 at a first transfer rate given by I1/C when said first control voltage is provided and said common output node is pulled down to V2 at a second transfer rate given by −I2/C when said second control voltage is provided, said common output node providing said voltage $V_{on}$.

* * * * *